US007264454B2

(12) United States Patent
Baier et al.

(10) Patent No.: US 7,264,454 B2
(45) Date of Patent: Sep. 4, 2007

(54) ROTARY COMBUSTION ENGINE WITH AN IMPROVED INNER SEAL

(75) Inventors: Wolfgang Baier, Obbach (DE); Manfred Mäthner, Leingarten (DE); Dankwart Eiermann, Weissenberg (DE); Rudolf Klotz, Cottbus (DE); Michael Schirmer, Zermsdorf (DE)

(73) Assignee: Wankel Super Tec GmbH, Cottbus (DE)

( * ) Notice: Subject to any disclaimer, the term of this patent is extended or adjusted under 35 U.S.C. 154(b) by 116 days.

(21) Appl. No.: 11/062,264

(22) Filed: Feb. 18, 2005

(65) Prior Publication Data

US 2005/0186102 A1 Aug. 25, 2005

(30) Foreign Application Priority Data

Feb. 20, 2004 (DE) ..... 10 2004 008 313

(51) Int. Cl.
*F01C 19/02* (2006.01)
*F01C 19/12* (2006.01)

(52) U.S. Cl. ..... 418/61.2; 418/61.1; 418/104; 418/113

(58) Field of Classification Search ..... 418/61.2, 418/61.1, 104, 113
See application file for complete search history.

(56) References Cited

U.S. PATENT DOCUMENTS 3,081,745 A * 3/1963 Hurley ..... 277/357
3,309,011 A * 3/1967 Sunao et al. ..... 418/142
3,915,599 A * 10/1975 Kawamura ..... 418/91
3,941,522 A * 3/1976 Acord ..... 418/61.2
4,395,206 A * 7/1983 Hoffmann ..... 418/61.2
4,487,561 A * 12/1984 Eiermann ..... 418/61.2
5,121,721 A * 6/1992 Bando ..... 123/242
5,299,811 A * 4/1994 Kershaw ..... 277/551

FOREIGN PATENT DOCUMENTS

JP 61200390 A * 9/1986

* cited by examiner

*Primary Examiner*—Thomas Denion
*Assistant Examiner*—Mary A Davis
(74) *Attorney, Agent, or Firm*—Cohen Pontani Lieberman & Pavane LLP

(57) ABSTRACT

A rotary combustion engine includes a peripheral housing, a front housing plate, a rear housing plate, a piston, and an eccentric shaft, where the piston rotates to form three working spaces separated from each other by the tips of the piston. Shaft seals and piston seals seal off the oil-carrying interior space of the internal combustion engine, and the piston is sealed off against the front and rear housing plates by arcuate strips, which are bounded radially on the inside by an envelope curve. The gas forming in the working space during the combustion phase is under high pressure. Some of this gas leaks around the arcuate strips and flows inward along the flat surfaces of the front and rear plates by way of ring-shaped channels in the piston, thus arriving in recessed areas inside the envelope curves, from which it is then escapes through vent channels.

16 Claims, 2 Drawing Sheets

ROTARY COMBUSTION ENGINE WITH AN IMPROVED INNER SEAL

BACKGROUND OF THE INVENTION

1. Field of the Invention

The invention pertains to a rotary combustion engine, comprising essentially a peripheral housing, a front housing plate, a rear housing plate, a piston, and an eccentric shaft. The triangular piston supported on the eccentric shaft rotates inside the peripheral housing between the front and rear housing plates along an epitrochoidal orbit with a long axis and short axis to form three working spaces separated from each other by the tips of the piston, where shaft seals and piston seals seal off the oil-carrying interior space of the internal combustion engine against the atmosphere and against the working space. The piston is sealed off against the front and rear housing plates by arcuate strips, which, during operation, pass over a surface on each plate which is bounded radially on the inside by an envelope curve.

2. Description of the Related Art

In rotary combustion engines of the known design, primarily ring-shaped constructions of piston ring material are used in series production to seal off the interior of the piston against leakage gas, which is under high pressure in the working space during the combustion phase and passes around the arcuate strips. These constructions were expensive to produce and did not offer sufficient sealing protection against oil leakage in the idle state of the machine. To provide such protection, additional sealing measures in the form of "standing" seals were necessary, which were associated with their own set of functional problems. Tests with elastic seals in place of the ring-shaped constructions of piston ring material were unsuccessful, because it was found too difficult to control lip seals acting in the axial direction in such a way that they exert uniform contact pressure, nor were these seals able over the long term to deal with the pulsations of leakage gas which occurred at high pressure differences.

SUMMARY OF THE INVENTION

Against this background, it is proposed that a seal for the interior of the piston be created to prevent gas leaking around the arcuate strips from entering the interior when high pressures build up in the working space during the combustion of the gas mixture. The success of the sealing action is based on two measures:

the shaft seals and the piston seals are no longer designed as seals which act axially against the front and rear plates but rather as radial seals, the contact pressure of which is easier to control; and the leakage gas is conducted away along a defined path through a vent channel in each of the two housing plates.

The radially inward-facing sealing lips of each piston seal contact a first sealing cylinder, and the radially inward-facing sealing lips of each shaft seal contact a second sealing cylinder, the two cylinders being located on sealing parts, which are connected to the eccentric. This applies equally to the front housing plate and to the rear housing plate, which means that a sealing part is located on each side of the eccentric. The piston seals are located in the piston near the flat surfaces of the front and rear housing plates, whereas the shaft seals are pressed into the front and rear housing plates and also extend up close to their flat surfaces. The sealing parts have collars, which project beyond the planes of the previously mentioned flat surfaces and into the hubs of the front and rear housing plates, where they cooperate with the second sealing cylinders to form the contact points for the sealing lips of the shaft seals. The lips of the shaft seals and of the piston seals consist of elastomeric material, i.e., material which performs its sealing task satisfactorily only when the gas pressures remain within a tolerable range.

When, as a result of the ignition of the gas mixture at top dead center, high pressure builds up in the working space, some of the gas will leak around the arcuate strips. The pressure reaches a maximum as the gas mixture expands during combustion and then decreases as the working space approaches bottom dead center. The three working spaces therefore act in succession on their arcuate strips primarily during the expansion phase. Because there is almost no volume available for expansion radially inside the arcuate strips, a volume is created here in the form of a ring-shaped groove, which is only a short distance away from the center area of the arcuate strips. This distance increases in the areas toward the tips of the piston, but this has no influence on the further guidance of the leakage gas into the ring-shaped groove.

So that undue stress is not exerted on the lips of the shaft seals and piston seals, it is proposed that the volumes of the ring-shaped grooves be connected to volumes in the front and rear housing plates, into which the leakage gas can escape. These volumes are in the form of recesses in the flat surfaces of the front and rear plates and are situated within a lemon-shaped envelope curve, which the arcuate strips trace on the front and rear plates as the piston rotates. It has been found advisable not to let the volumes extend all the way to the envelope curve but rather to locate them inside a radially inner line equidistant to this envelope curve, which helps to prevent imprecise manufacturing. Because of the way the machine operates, the ring-shaped grooves now pass continuously over these recessed areas while the engine is operating, more than half of the groove remaining over the recess, as a result of which the leakage gas which enters the ring-shaped groove has free passage into the recessed area. The leakage gas proceeds from there by way of at least one bore, which connects the recessed area to at least one vent channel in each of the two housing plates. This vent channel is preferably connected to an oil tank, from which the internal combustion engine obtains its lubricating oil. It can be seen that the leakage gas coming from the arcuate strips is trapped by the ring-shaped grooves, which are located radially outside the piston seals and the shaft seals. The pressure in the ring-shaped grooves is nearly the same as atmospheric pressure, because the grooves are in direct connection with the atmospherically vented oil tank via the recessed areas, the bores, and the vent channels.

Upon consideration of the movement of the ring-shaped grooves across the front and rear housing plates, it becomes obvious that, instead of providing the recessed area, it would in fact be sufficient to machine vent grooves along the short axis in the area defined by the equidistant lines. It is at this point, namely, that the ring-shaped groove continuously intersects the vent grooves and thus forms an interface, which guarantees uninterrupted passage for the leakage gas under the assumption that the bores located in the vent grooves are connected to the vent channels in the front and rear housing plates.

For a rotary combustion engine, it is therefore the task of the invention to trap and to carry away the gas which leaks past the arcuate strips as a result of the high pressure which builds up in the working space upon the ignition and expansion of the gas mixture, so that sufficiently favorable conditions can be created for the use of shaft seals and piston seals designed as radial seals with sealing lips of elastomeric material.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figures 1, 1A:
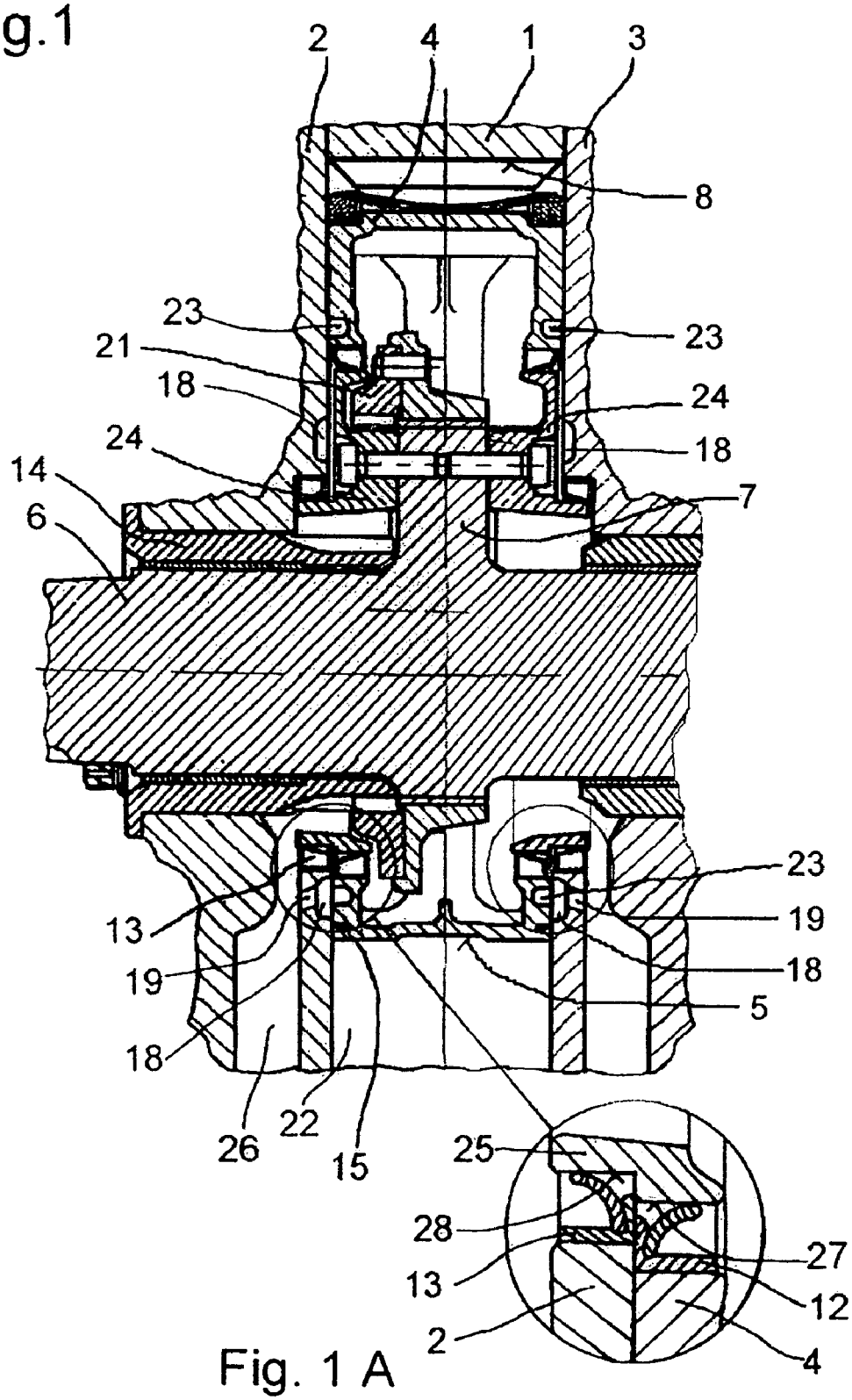
FIG. 1 shows a partial cross section of a rotary combustion engine with a peripheral housing, a front and rear housing plate, and a piston with ring-shaped grooves in its flat surfaces.
FIG. 1A is an enlarged view of a sealing part with a piston seal and shaft seal.
Figure 2:
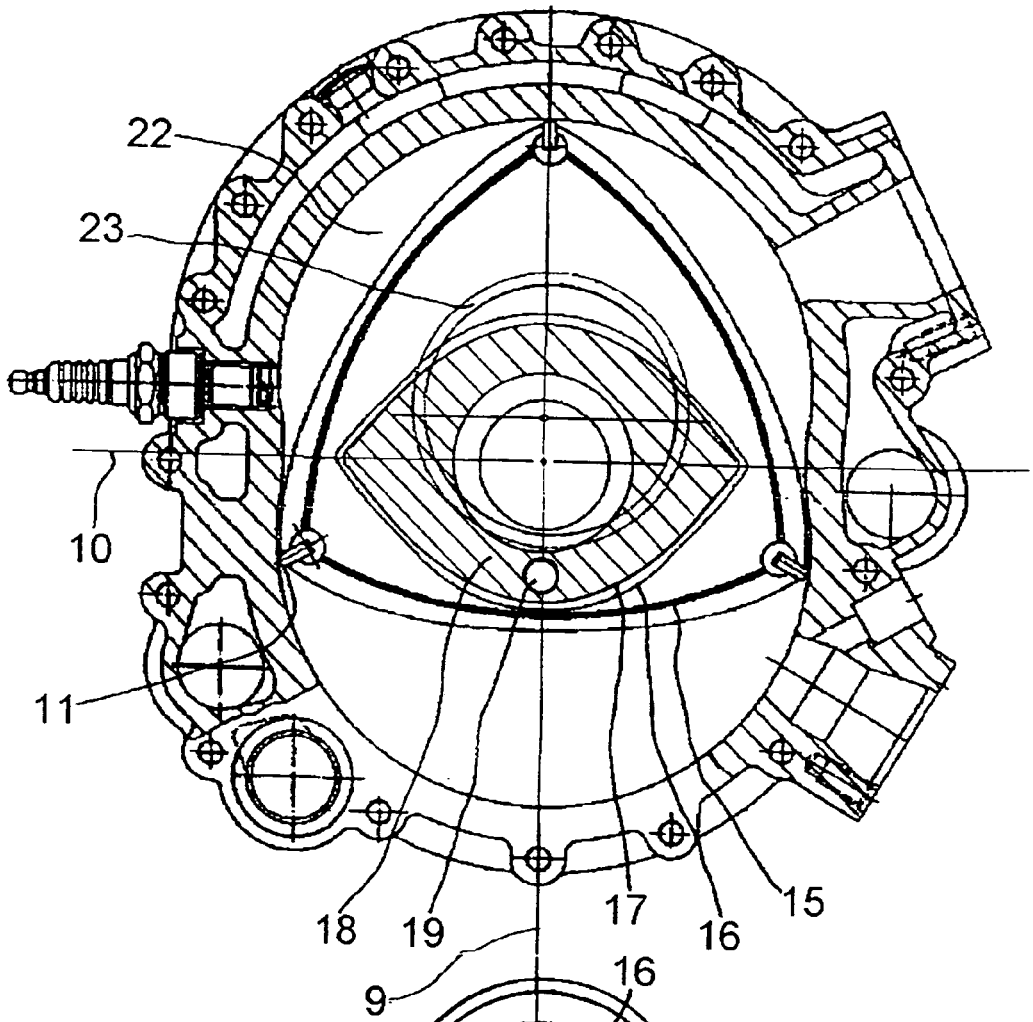
FIG. 2 shows the peripheral housing, the piston, and either one of the housing plates with an envelope curve and the position of the ring-shaped groove drawn thereon.

Referring to FIGS. 1 and 2, the peripheral housing 1 cooperates with a front housing plate 2 and a rear housing plate 3 to form a housing, in which a piston is installed, which has three tips 11. The tips slide along an epitrochoidal orbit 8 with a long axis 9 and a short axis 10. The tips cooperate with the faces 5 of the piston to form three closed working spaces 22, in which a four-phase cycle takes place, during which high pressures build up especially during the ignition of the gas mixture and the expansion phase. Sealing elements are located along the sides of the face 5, including arcuate strips 15, each of which extends from one tip 11 of the piston 4 to another. These strips are directed toward the flat surfaces of the front housing plate 2 and the rear housing plate 3. The high pressures generate leakage gases at all of the sealing elements. At the tips 11, the gas leaks from one working space 22 to another working space 22, but at the arcuate strips 15 it flows into the interior of the internal combustion engine, where it can cause damage primarily to the piston seals 12 and to the shaft seals 13.

The piston 4 is rotatably supported on an eccentric 7 of an eccentric shaft 6, and an internal gear 21 is mounted on the piston 4. The teeth of this gear engage with the teeth of a sun wheel 14 to coordinate the movement of the piston 4. Piston seals 12 are mounted in the piston 4, on each of its flat surfaces. These seals are designed as radial seals, the sealing lips of each seal running along a first sealing cylinder 27 of each sealing part 24. One of these sealing parts 24 is mounted on each side of the eccentric 7 and each has a collar 25, which projects into the hub of the housing plate 2, 3. Each collar also has a second sealing cylinder 28, which serves as a raceway for the sealing lips of the shaft seal 13, one of which is pressed into each of the two housing plates 2, 3.

A ring-shaped groove 23 is provided in each of the two faces of the piston 4; these grooves are located in the area between the arcuate strips 15 and the piston seals 12 and are concentric to them. According to FIG. 2, each of the ring-shaped grooves 23 passes over the area of the envelope curve 16, which is traced by the arcuate strips 15. The envelope curve 16 has an inner equidistant line 17, which represents the outer boundary of a recessed area 18, one of which is preferably provided in each of the two housing plates 2, 3. The recessed areas 18 are therefore in continuous communication with the ring-shaped grooves 23 and are thus able to carry the leakage gases away. It can also be derived from the FIG. 1 that the recessed area 18 is connected by at least one bore 19 through the plate 2, 3 to a vent channel 26, through which the leakage gas can finally be discharged.

Figure 3:
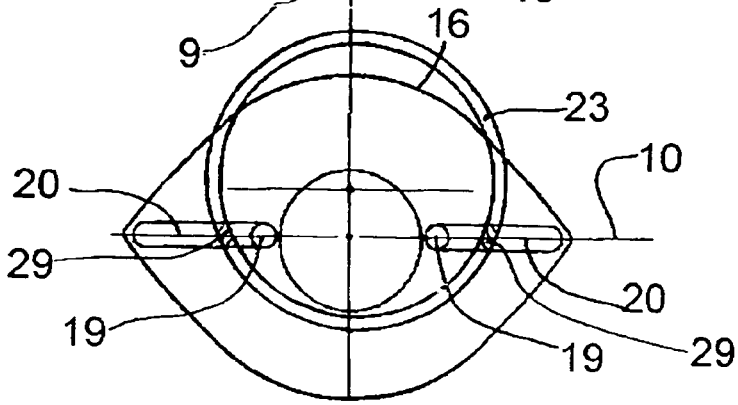
FIG. 3 shows a schematic diagram of the envelope curve with the ring-shaped groove and two vent grooves, each with its own bore.

According to FIG. 3, vent grooves 20 are located inside the envelope curve 16 along the short axis 10. The ring-shaped groove 23 in the piston passes continuously over these vent grooves, which provide a passageway for the leakage gas at the interfaces 29, through which the gas can escape into the vent channels 26 via the bores 19' located in the vent grooves 20. The advantage of the invention is that the leakage gas can no longer create any pressure peaks in the area of the piston seals 12 and the shaft seals 13, peaks which could negatively affect the service life of these seals 12, 13.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rotary combustion engine comprising:

a peripheral housing describing an epitrochoidal orbit having a long axis and a short axis;

a front housing plate;

a rear housing plate;

an eccentric shaft mounted for rotation in a rotational direction;

a triangular piston mounted for rotation on said eccentric shaft between said housing plates, said piston having side faces facing respective said plates and three tips which contact said epitrochoidal orbit to form three working spaces which pass successively through a combustion phase;

three arcuate strips on each of said side faces sealing said piston against each of said front and rear housing plates, said arcuate strips, during rotation, passing over an area on each plate which is bounded radially on the inside by an envelope curve;

a piston seal sealing each face of said piston against the eccentric shaft; and a gas passageway which guides leakage gas leaking around the arc shaped strips during the combustion phase radially inward along the front and rear housing plates and through the plates to respective vent channels.

2. The rotary combustion engine of claim 1 wherein the gas passageway comprises a circular groove located in each of said side faces of the piston concentrically with the center of the piston, said groove being located between the arcuate strips and the piston seal.

3. The rotary combustion engine of claim 2 wherein the gas passageway further comprises a recess in each of the front and rear housing plates, each said recess lying inside the envelope curve.

4. The rotary combustion engine of claim 3 wherein the gas passageway further comprises at least one bore though each of said plates, each said bore connecting a respective said recess to the vent channel.

5. The rotary engine of claim 3 wherein each said recess is bounded by a line equidistant to the envelope curve.

6. The rotary combustion engine of claim 2 wherein the gas passageway further comprises:

at least one vent groove in each of said housing plates, and at least one bore through each of said plates, each said bore connecting a respective vent groove to the vent channel.

7. The rotary combustion engine of claim 6 comprising two said vent grooves on each of said plates, said vent grooves lying on the short axis inside the envelope curve.

8. A rotary combustion engine comprising:

a peripheral housing describing an epitrochoidal orbit having a long axis and a short axis;

a front housing plate;

a rear housing plate;

an eccentric shaft mounted for rotation in a rotational direction;

a triangular piston mounted for rotation on said eccentric shaft between said housing plates, said piston having side faces facing said plates and three tips which contact said epitrochoidal orbit to form three working spaces which pass successively through a combustion phase;

three arcuate strips on each of said side faces sealing said piston against each of said front and rear housing plates, said arcuate strips, during rotation, passing over an area on each plate which is bounded radially on the inside by an envelope curve;

a pair of radially acting piston seals fixed in said piston and sealing respective said faces of said piston against the eccentric shaft; and a radially acting shaft seal fixed in each of said front and rear housing plates and sealing respective said plates against the eccentric shaft.

9. The rotary combustion engine of claim 8 wherein the eccentric shaft comprises an eccentric having axially opposed sides and a sealing part fixed to each said side of said eccentric, each said sealing part having a first sealing cylinder which is borne against radially by a respective said piston seal, and a second sealing cylinder which is borne against radially by a respective said shaft seal.

10. The rotary combustion engine of claim 9 wherein each of said seals comprises an elastomeric sealing lip which is loaded radially against a respective said sealing cylinder.

11. A rotary combustion engine comprising:

a peripheral housing describing an epitrochoidal orbit having a long axis and a short axis;

a front housing plate;

a rear housing plate;

an eccentric shaft mounted for rotation in a rotational direction;

a triangular piston mounted for rotation on said eccentric shaft between said housing plates, said piston having a side face facing said front housing plate and three tips which contact said epitrochoidal orbit to form three working spaces which pass successively through a combustion phase;

three arcuate strips on said side face sealing said piston against said front housing plate, said arcuate strips, during rotation, passing over an area on said front housing plate which is bounded radially on the inside by an envelope curve;

a piston seal sealing said front face of said piston against the eccentric shaft; and a gas passageway which guides leakage gas leaking around the arc shaped strips during the combustion phase radially inward along the front housing plate and through the plate to a vent channel, wherein the gas passageway comprises a circular groove located in said side face of the piston concentrically with the center of the piston, said groove being located between the arcuate strips and the piston seal.

12. The rotary combustion engine of claim 11 wherein the gas passageway further comprises a recess in said front housing plate, said recess lying inside the envelope curve.

13. The rotary combustion engine of claim 12 wherein the gas passageway further comprises at least one bore though said front housing plate, said bore connecting said recess to said vent channel.

14. The rotary engine of claim 12 wherein said recess is bounded by a line equidistant to the envelope curve.

15. The rotary combustion engine of claim 11 wherein the gas passageway further comprises:

at least one vent groove in said front housing plate, and at least one bore through said front housing plate, said bore connecting said vent groove to the vent channel.

16. The rotary combustion engine of claim 15 comprising two said vent grooves on said front housing plate, said vent grooves lying on the short axis inside the envelope curve.

* * * * *